US005881622A

United States Patent [19]

Kaipf

[11] Patent Number: 5,881,622

[45] Date of Patent: Mar. 16, 1999

[54] DEVICE FOR PERFORATING A RUNNING WEB

[75] Inventor: Walter Kaipf, Haunsheim, Germany

[73] Assignee: Voith Sulzerpapiermaschinen GmbH, Germany

[21] Appl. No.: 652,925

[22] Filed: May 24, 1996

[30] Foreign Application Priority Data

May 26, 1995 [DE] Germany ..... 295 08 732.3

[51] Int. Cl.[6] ..... B26D 1/38

[52] U.S. Cl. ..... 83/349; 83/660; 225/97

[58] Field of Search ..... 83/660, 610, 346, 83/345, 349; 225/1, 4, 5, 97, 104, 93; 242/526.1, 525.4

[56] References Cited

U.S. PATENT DOCUMENTS

| | | | |
|---|---|---|---|
| Re. 28,911 | 7/1976 | Jespersen et al. | 83/660 X |
| 2,143,507 | 1/1939 | Chandler | 83/237 |
| 2,237,759 | 4/1941 | Kwitek | 83/345 X |
| 2,266,995 | 12/1941 | Schultz et al. | 225/96 X |
| 2,328,109 | 8/1943 | Thompson | 242/526.1 X |
| 2,871,939 | 2/1959 | Close | 83/610 X |
| 3,111,285 | 11/1963 | Coker et al. | 226/195 |
| 3,147,658 | 9/1964 | Boyd | 83/660 X |
| 3,172,612 | 3/1965 | Besserdich | 242/526.1 X |
| 3,277,761 | 10/1966 | Dreher | 83/614 |
| 3,517,578 | 6/1970 | Krofta | 83/98 |
| 3,727,853 | 4/1973 | Kinoshita | 242/532.3 |
| 3,977,310 | 8/1976 | Keck et al. | 83/880 X |
| 4,027,828 | 6/1977 | Mathieson | 242/526.1 X |
| 4,133,495 | 1/1979 | Dowd | 242/532.2 |
| 4,404,880 | 9/1983 | DeLuca | 83/345 X |
| 4,444,360 | 4/1984 | Kaipf et al. | 242/526 |
| 4,745,835 | 5/1988 | Schnitzer | 83/660 X |
| 4,775,110 | 10/1988 | Welp et al. | 242/532.3 X |
| 4,962,686 | 10/1990 | Boyd et al. | 83/678 |
| 4,972,747 | 11/1990 | Boyd et al. | 83/678 |
| 5,240,755 | 8/1993 | Zimmer | 83/660 X |
| 5,312,058 | 5/1994 | Brandt et al. | 83/614 X |

FOREIGN PATENT DOCUMENTS

| | | |
|---|---|---|
| 1938234 | 2/1970 | Germany . |
| 3611895 | 8/1991 | Germany . |
| 4034997 | 10/1993 | Germany . |

*Primary Examiner*—M. Rachuba

*Attorney, Agent, or Firm*—Ostrolenk, Faber, Gerb & Soffen, LLP

[57] ABSTRACT

A device for producing a track of perforations transverse to a paper web including a support for advancing the web past the device, a rotatable shaft at one side of the web, a perforating comb supported on and rotatable on the shaft when the shaft is rotated. A web support body on the opposite side of the web from the shaft contains a groove in the underside of the web support body into which the perforation comb teeth extend when the perforation comb rotates past the web. The web contacts the underside of the web support body and also the ends of transverse ribs which divide the groove in the web support body into individual sections.

11 Claims, 1 Drawing Sheet

DEVICE FOR PERFORATING A RUNNING WEB

BACKGROUND OF THE INVENTION

The invention relates to a device for producing a perforation track in an advancing web, e.g. a paper web, by comb teeth piercing the web.

A preferred use for this device is in a winding machines, in which a web is wound up to form a reel. For performing a reel change, a perforation track running transverse to the web running direction is produced in the web by the device. Following this, the web is severed along the perforation track.

Perforation track forming devices are disclosed in:

(1) DE 36 11 895 C2

(2) DE 40 34 997 C1

(3) DE OS 1 938 234

Known devices for perforating a running paper web have disadvantages. The perforation device according to FIG. 2 in document (1) has a shaft with a comb which cooperates with a mating roll having a resilient cover. When the perforation device is not operating, the perforation comb is located at a position in which it does not contact the paper web. To lay a perforation track in the paper web, the shaft makes one revolution. The perforation comb is thereby moved into and then out of the paper web and it leaves a perforation track. This device has the disadvantage that its construction is very complex. Its control means must operate very precisely because the shaft and the mating roll must run in synchronism with the paper web. Otherwise, premature severing of the web results.

In the embodiment of FIG. 1 in document (1), the shaft runs in the opposite direction to the paper web. This leads to an undefined perforation and to the risk of a web break during the perforation process.

Document (2) discloses a device for severing a paper web. In this case, while the machine (e.g. the winding machine) is stationary, pressure is applied to the web which is resting on a supporting roll, in order to crush the web and hence to weaken it. The web is then completely severed by increasing the web tension. This device has the disadvantage that the winding machine must be stopped for the purpose of weakening the web. As a result, the reel change process takes a relatively long time. In addition, there is a risk of damage to the surface of the supporting roll.

Document (3) shows a supported web being pierced by comb teeth, but does show a support not for piercing transversely across a web, which is the problem with which the invention is concerned.

SUMMARY OF THE INVENTION

The invention has as an object of providing a device for perforating a paper web which is simple in construction, which demands no high outlay for its controls and with which a perforation track can be laid reliably and reproducibly over the web width.

A device for producing a track of perforations transverse to a paper web includes a support for advancing the web past the device, a rotatable shaft above one side of the web, and web perforating means in the form of a perforating comb supported on and rotatable on the shaft axis. A web support body above the opposite side of the web from the shaft has a groove in the underside of its body into which the perforation comb teeth extend when the perforation comb rotates past the web. The web contacts the underside of the support body and also the ends of transverse ribs which divide the groove in the support body into sections.

The device according to the invention has a simple construction, requires no complicated controls and operates reliably. This is true even if the web is not particularly highly tensioned in the running direction, that is, the web is under low web draw. The invention permits a perforation track to be applied at a precisely definable point along the web in spite of the machine continuing to run. Premature tearing through of the web is reliably avoided.

Particularly good results can be achieved when the invention is refined as described above. The points of the perforation comb can plunge into the groove in the web supporting body, without contacting the body. The length of the groove sections, measured transversely to the web running direction, and hence their number should be selected such that the web is supported by the body and the ribs and does not yield during piercing of the web by the perforation comb. That lengths of the groove sections depends on the properties of the web, in particular on its stiffness. For instance, thin paper webs of low stiffness require a great number of groove sections of short length, while relatively thick and stiff paper webs require a lower number of groove sections with correspondingly relatively greater length. The width of the transverse ribs which separate the groove sections from one another is selected to be as small as possible, for example only 2 to 4 mm, so that those regions of the perforation comb which are free of points could be kept as short as possible.

Other objects and features of the invention are explained with reference to the drawings.

DESCRIPTION OF A PREFERRED EMBODIMENT OF THE INVENTION

Figure 1:
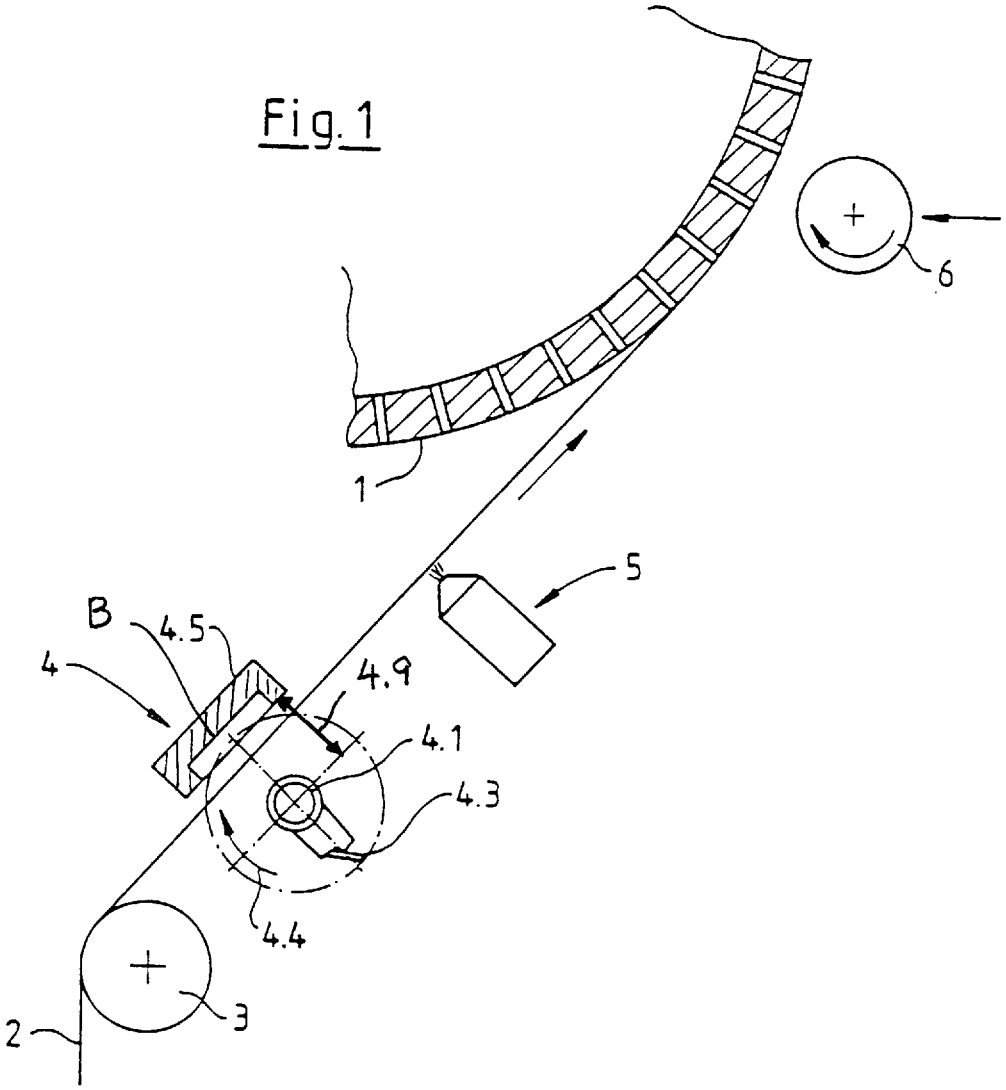
FIG. 1 is a schematic side view of a perforation apparatus.

FIG. 1 shows a web supporting roll 1, which has a perforated roll cover. The supporting roll can, for example, be a conventional component of a winding machine for winding up a paper web. FIG. 1 also depicts pressing roll 6.

A paper web 2 is led up from below over a guide roll 3 and onto and around the supporting roll 1. The web runs through the perforation device 4 according to the invention and then on a device 5 for the application of a glue track. The glue application is not part of the invention here.

Figure 2:
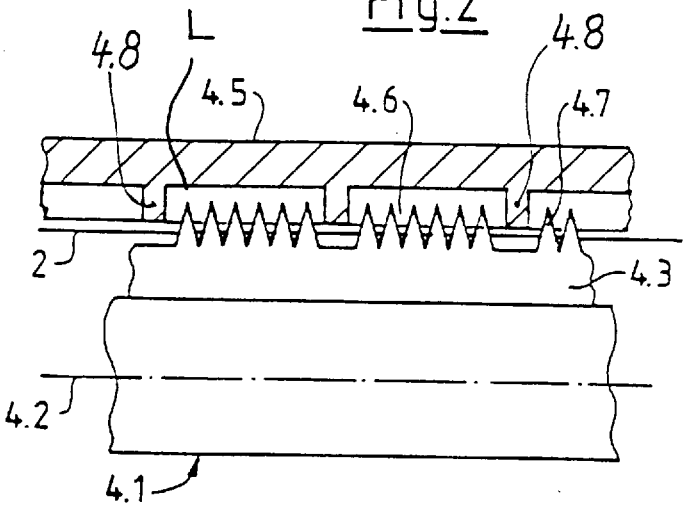
FIG. 2 is a view transverse to FIG. 1 of part of the perforation apparatus.

In FIG. 2, the perforation device 4 according to the invention comprises a rotatably mounted shaft 4.1. The axis 4.2 of the shaft runs parallel to the web 2 but extends transversely to the web running direction and over the entire web width. Shaft 4.1 has a perforation comb 4.3 projecting radially off its periphery and the comb rotates with the shaft around axis 4.2. The shaft 4.1 has a drive so that it can be rotated in the direction of web advance shown by the arrow 4.4.

Above the side of the web 2 opposite the shaft 4.1 there is a supporting body 4.5 which also extends transverse to the web width, like the shaft 4.1. The supporting body 4.5 has a plurality of cutouts or groove sections 4.6 which are open toward the paper web 2. Each groove section extends the length of several perforation comb teeth or even past all of those teeth. In other words, the supporting body 4.5 has, in principle, the shape of a groove which is open towards the web. The groove can have transverse ribs 4.8, which subdivide the interior of the groove, producing several groove sections 4.6. These ribs extend toward the web so as to be substantially even with the bottom side of the supporting body 4.5, so that both the bottom of the supporting body 4.5 and the ends of the ribs support the paper web against the pressure of the perforation comb teeth. There are no comb teeth opposite the ribs 4.8 so as to avoid interference between them.

The comb 4.3, on the one hand, and the groove sections 4.6, on the other hand, are configured and arranged so that the comb or its points or teeth 4.7 can extend into the groove sections 4.6 when the shaft 4.1 rotates and the comb comes into that position in which its points 4.7 pierce the paper web 2. However, because the supporting body 4.5 and the ribs 4.8 support the web, when the web is pierced, there is no contact between the comb 4.3 and the supporting body 4.5.

The shaft 4.1, the perforation comb 4.3 fastened thereon and the supporting body 4.5 preferably extend over the entire web width. However, it may suffice in an individual case if these three elements extend only over part of the web width.

The lengths L of the groove sections 4.6 is, as explained above, a function of the paper grade. The width B of the transverse ribs 4.8 is selected to be as small as possible, e.g., less than 10 mm, particularly less than 5 mm, and preferably only 2 to 4 mm. Comb teeth are omitted at the positions of the ribs 4.8, so it is desirable for those ribs to be thin in order that the perforation track have only short interruptions.

The above device operates as follows:

In the normal state, that is, when the paper web 2 is being wound up to form a paper reel, the shaft 4.1 is located in the angular position shown in FIG. 1, in which the comb 4.3 is facing away from the supporting body 4.5. To place a perforation track in the paper web 2, the shaft 4.1 is rotated one revolution, so that the perforating comb 4.3 teeth 4.7 pierce through the paper web 2 and then are withdrawn from out of the web, as a result of the further rotation of the shaft 4.1.

The circumferential speed of the teeth 4.7 need not be exactly equal to the speed of the web 2. Both a somewhat higher speed and a somewhat lower speed are also useable. At a higher speed, perforation slits which are relatively short are produced in the running direction of the paper web 2, while at a slower speed, the slits produced are relatively long.

The distance between the shaft 4.1 and the supporting body 4.5 is adjustable, as is indicated schematically by double arrow 4.9.

The supporting roll 1 has an associated web holder which can be pressed against the supporting roll for holding the new web start following the severing of the web.

An important advantage of the invention as compared with the embodiment in the prior art document (1), FIG. 1, is as follows. There, the roll 8, which is equipped with a knife 9, must be moved away from the paper web in order to be brought out of engagement with the web. With the present invention, such motion of the shaft 4.1 is not necessary. The shaft 4.1 is already at a corresponding distance from the paper web 2.

The invention can be used preferably (but not exclusively) in the case of the reel change method according to German Patent Application 195 19 306.7 corresponding to allowed U.S. Application Ser. No. 08/654,279.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A device for producing a perforation track in a running web moving past the device, wherein the perforation track extends transverse to a running direction of the web, the device comprising:

means for moving the web in the running direction past the device;

a rotatably mounted shaft extending transversely to the running direction, the shaft being positioned next to a first side of the paper web, the shaft having an axis;

perforation means projecting out from the axis of the shaft and substantially extending along the length of the shaft for piercing through the paper web passing by the device to form a perforation track across the web when the shaft is rotated to the position where the perforation means can contact and pierce the web;

a web support device positioned next to a second side of the paper web opposite the first side of the web and the perforation means, the web support device having a stationary body having a side facing toward the web and at least one groove in the side of the stationary body, wherein as the shaft rotates the perforation means past the body, the web is pressed by the perforation means against the side of the stationary body and the perforation means pierces the web and enters the groove as the shaft rotates, forming perforations in the web, and continued rotation of the shaft removes the perforation means from the paper web upon further advancing of the web beyond the web support device.

2. The device of claim 1, wherein comprising the position of the shaft relative to the stationary body is adjustable.

3. The device of claim 1, wherein the web has a width and wherein the shaft, the perforation means and the web supporting device all extend transversely over the entire width of the web.

4. The device of claim 1, wherein the perforation means comprises a perforation comb with comb teeth that pierce the web.

5. The device of claim 4, wherein the web support device further comprises at least one rib extending across the groove in the running direction of the web and dividing the groove into sections, the rib being shaped and of a height to support the web being pushed toward the groove by the perforation comb.

6. The device of claim 5, wherein the perforation comb is shaped to lack comb teeth to press against the web at locations along the comb at the at least one rib.

7. The device of claim 5, wherein a length of each divided section of the groove between adjacent ribs is approximately 20 to 200 mm.

8. The device of claim 7, wherein a width of an individual transverse rib transversely of the web is less than 10 mm.

9. The device of claim 7, wherein a width of an individual transverse rib transversely of the web is less than 5 mm.

10. The device of claim 7, wherein a width of an individual transverse rib transversely of the web is between 2 to 4 mm.

11. The device of claim 1, wherein the web support device further comprises at least one rib extending across the groove in the running direction of the web and dividing the groove into sections, and the rib being shaped and of a height to support the web being pushed toward the groove by the perforation means, the perforation being shaped to avoid interference between the perforation means and the at least one rib.

* * * * *